US007077209B2

(12) United States Patent
McCulloch et al.

(10) Patent No.: US 7,077,209 B2
(45) Date of Patent: Jul. 18, 2006

(54) MAST FOR HANDLING A COILED TUBING INJECTOR

(75) Inventors: David W. McCulloch, Arlington, TX (US); Mike Xiaolei Lu, Arlington, TX (US)

(73) Assignee: Varco/IP, Inc., Houston, TX (US)

( * ) Notice: Subject to any disclaimer, the term of this patent is extended or adjusted under 35 U.S.C. 154(b) by 0 days.

(21) Appl. No.: 10/065,523

(22) Filed: Oct. 25, 2002

(65) Prior Publication Data

US 2003/0079883 A1 May 1, 2003

Related U.S. Application Data

(60) Provisional application No. 60/334,868, filed on Oct. 30, 2001.

(51) Int. Cl.
*E21B 19/086* (2006.01)
*E21B 19/02* (2006.01)

(52) U.S. Cl. ..... 166/379; 166/77.4; 166/85.4; 414/22.55

(58) Field of Classification Search ..... 166/378, 166/379, 381, 77.1, 77.2, 77.3, 77.4, 77.51, 166/85.1, 85.4, 98; 414/22.51, 22.55
See application file for complete search history.

(56) References Cited

U.S. PATENT DOCUMENTS 3,840,128 A * 10/1974 Swoboda et al. ..... 414/728
3,841,407 A * 10/1974 Bozeman ..... 166/384
4,249,600 A * 2/1981 Bailey ..... 166/77.2
4,251,176 A * 2/1981 Sizer et al. ..... 414/22.71
4,265,304 A * 5/1981 Baugh ..... 166/77.2
4,290,495 A * 9/1981 Elliston ..... 175/85
4,291,762 A * 9/1981 Gudgel ..... 166/85.4
4,336,840 A * 6/1982 Bailey ..... 166/77.4
5,222,564 A 6/1993 Bonca
5,836,385 A * 11/1998 Koopmans ..... 166/77.1
5,839,514 A * 11/1998 Gipson ..... 166/384
5,937,943 A * 8/1999 Butler ..... 166/77.2
6,003,598 A * 12/1999 Andreychuk ..... 166/76.1
6,234,253 B1 * 5/2001 Dallas ..... 166/377
6,264,128 B1 * 7/2001 Shampine et al. ..... 242/397.3
6,273,188 B1 * 8/2001 McCafferty et al. ..... 166/77.2
6,361,262 B1 * 3/2002 Roodenburg ..... 414/22.51
6,431,286 B1 * 8/2002 Andreychuk ..... 166/384
6,502,641 B1 * 1/2003 Carriere et al. ..... 166/384
2002/0125014 A1 * 9/2002 Dearing et al. ..... 166/384

FOREIGN PATENT DOCUMENTS

DE 32 28 742 A1 2/1984
DE 33 12559 A1 10/1984
EP 0 548 900 A2 6/1993
JP 10-120369 A 5/1998

* cited by examiner

*Primary Examiner*—Jennifer H. Gay
(74) *Attorney, Agent, or Firm*—Munsch Hardt Kopf & Harr PC

(57) ABSTRACT

A mast for lifting and suspending over a wellhead a coiled tubing injector and blow out preventer is pivotally mounted on a rear portion of a truck. The mast has two side-by-side telescoping legs that extend and retract synchronously. When in a retracted position, the blow out preventer and coiled tubing injector are attached to the mast, between the legs, and legs of the mast extended to lift the equipment.

40 Claims, 13 Drawing Sheets

MAST FOR HANDLING A COILED TUBING INJECTOR

CROSS REFERENCE TO RELATED APPLICATIONS

This application claims priority to related provisional patent application No. 60/334,868 entitled, "Mast for Handling a Coiled Tubing Injector" filed Oct. 30, 2001, which is incorporated herein by reference.

BACKGROUND OF INVENTION

Coiled tubing injectors are used to run in and out of well bores continuous pipe. Continuous pipe is referred to as coiled tubing because it is stored on large reel. Though coiled tubing can be used for drilling operations, it is ideal for servicing existing wells. It can be run in and out of the well bore much faster than conventional, jointed pipe. Furthermore, no complex drilling rig or other structure needs to be erected at the well. A crane is transported to the site, along with the blow out preventer, coiled tubing and coiled tubing injector, on the back of a truck. The crane is used to hoist and hold a blow out preventer and coiled tubing injector over the wellhead during servicing. With a conventional boom, the crane relies on a cable and winch to raise and lower the injector and blow out preventer. A hook at the free end of the cable connects the injector to the cable.

SUMMARY OF INVENTION

Winches and cables used on the cranes that hoist the injector over the wellhead are prone to failure. Failure of any of these elements can result in significant damage to the wellhead and creates a safety risk.

Unlike a conventional crane, a mast according to the invention raises and holds an injector or other oil field equipment over a wellhead using at least two telescoping arms. The equipment is placed between the arms, near a top end of the arms. Telescoping the arms raises the injector. Pivoting the mast moves the injector or other equipment over the wellhead. Such a mast need not utilize elements such as winches and cables to hoist the oil field equipment. Therefore, it can be made less susceptible to failure.

According to one aspect of a preferred embodiment of the invention, each arm is extended and retracted by use of a jackscrew. Each jackscrew preferably has a low pitch that makes it self-locking, thereby preventing collapsing of the legs under the weight of an injector if power is lost or interrupted. For arms with more than two segments, a lifting chain can be used to lift each additional segment. For example, in an arm with three segments, a lifting chain anchored at the top of the first segment extends up over a sprocket or pulley on top of the second segment and then back down to attach to a bottom of the third telescoping segment. The lifting chain pulls the third segment out of the second segment the second segment is pulled out of the first segment.

Another aspect of a preferred embodiment of the invention is a transportable multi-arm mast that pivots to a stowed position for transport with an injector and blow out preventer between the arms of the mast. During storage or transport, the injector and blow out preventer tilt backwards along with the mast. When deployed, the mast, injector and blower out preventer are moved to an upright position, preferably in a single action, with the injector positioned so that it can be picked up by the mast and then lowered onto the top of the blow out preventer for assembly. Once assembled, the injector and blow out preventer can then be raised and placed over the wellhead.

Another aspect of a preferred embodiment of the invention includes an arrangement for preventing an extendable mast from being pivoting too far (for example, to a point of potential instability) based on how far the mast is extended. The further the mast is extended, the greater the leverage is of a load carried by it. One particularly advantageous application is an extendable mast that pivots by means of a mechanism such as a hydraulic cylinder. The hydraulic cylinder is at one end coupled to the mast and at the other end to a movable mounting on a base or platform for the mast. The mounting is moved based on the degree to which the mast is extended. The mounting is posited where, with the fullest extension of the hydraulic cylinder, the resulting degree of pivot of the mast is at or less than a predetermined maximum angle for the amount of extension of the mast. Thus, the extendable mast can be prevented from being extended too far based on its extension. The relationship between the position of the mounting and extension of the mast may be adjustable based on the weight of an actual load carried by the mast, or may be set based on a maximum or expected load. Furthermore, the arrangement is self correcting. In the given example, if the hydraulic cylinder is already fully extended, the mast will be automatically pivoted to a more upright position as the mast is extended by movement of the mounting.

The accompanying drawings illustrate an example of a mast for handling a coiled tubing injector incorporating preferred embodiments of various aspects of the invention.

DETAILED DESCRIPTION

Like numbers refer to like elements in the following description.

Figure 1:
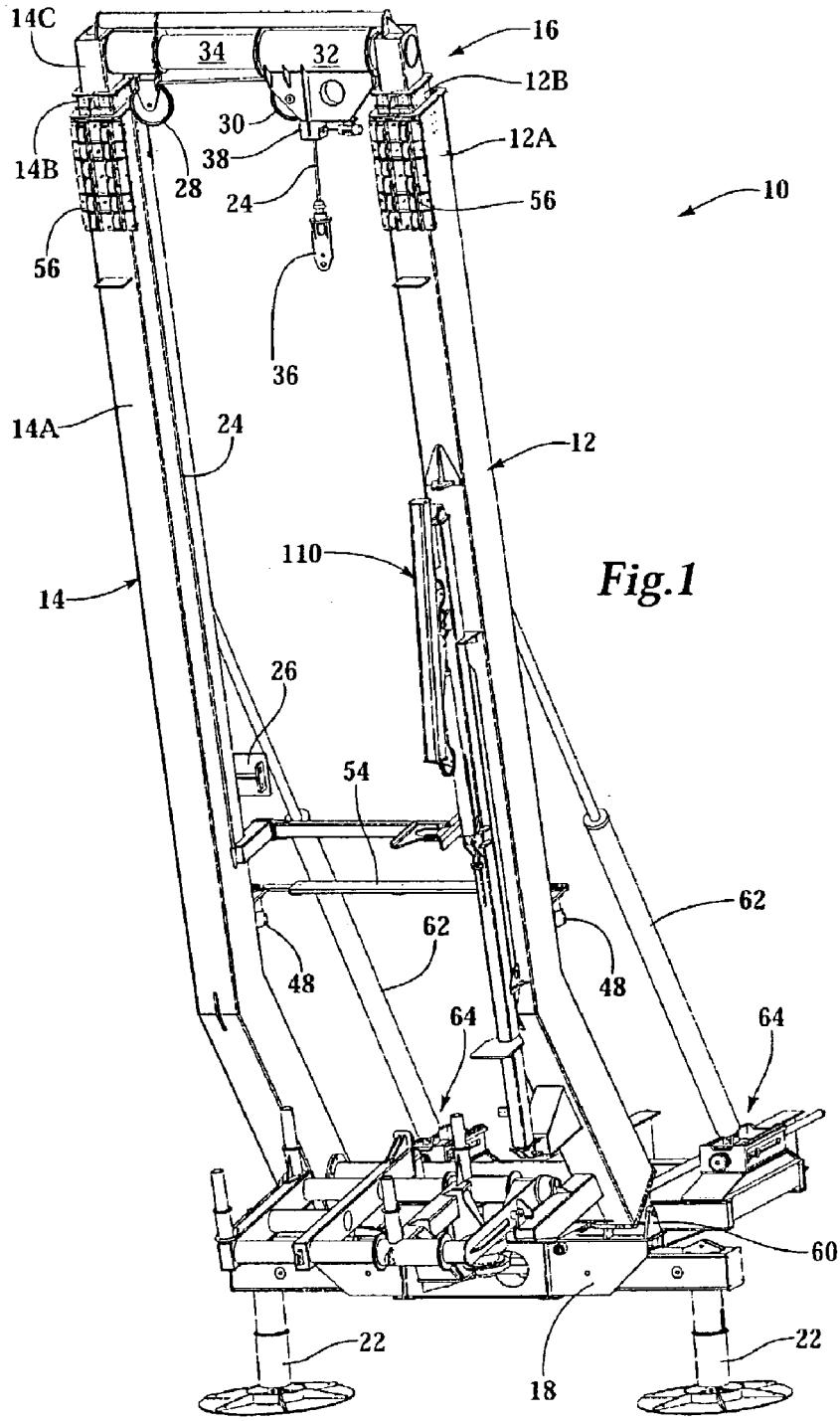
FIG. 1 is a perspective view of one embodiment of a mast assembly for handling a coiled tubing injector.
Figure 2:
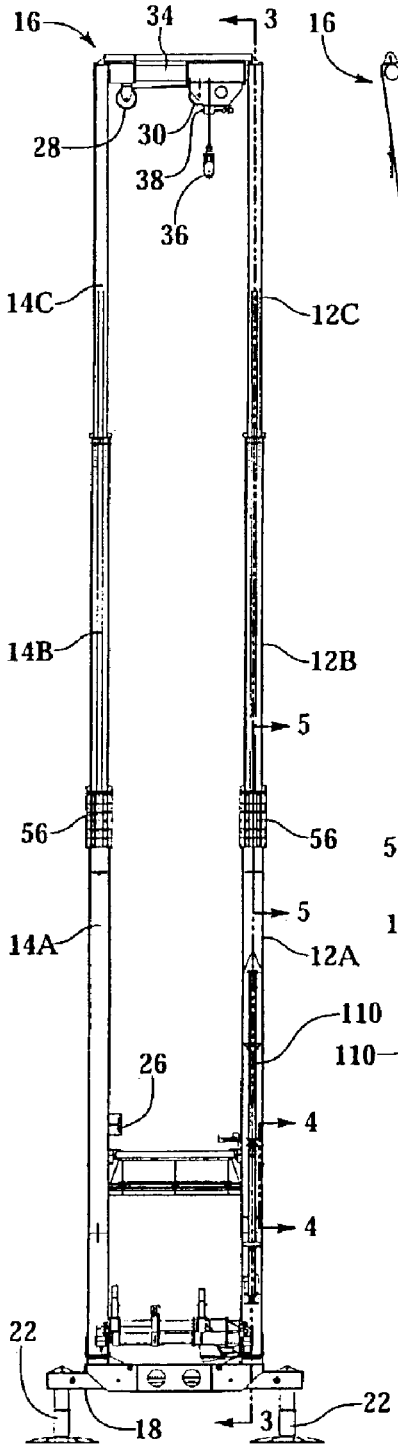
FIG. 2 is a front view of the mast assembly of FIG. 1, with the mast assembly fully extended.
Figure 3:
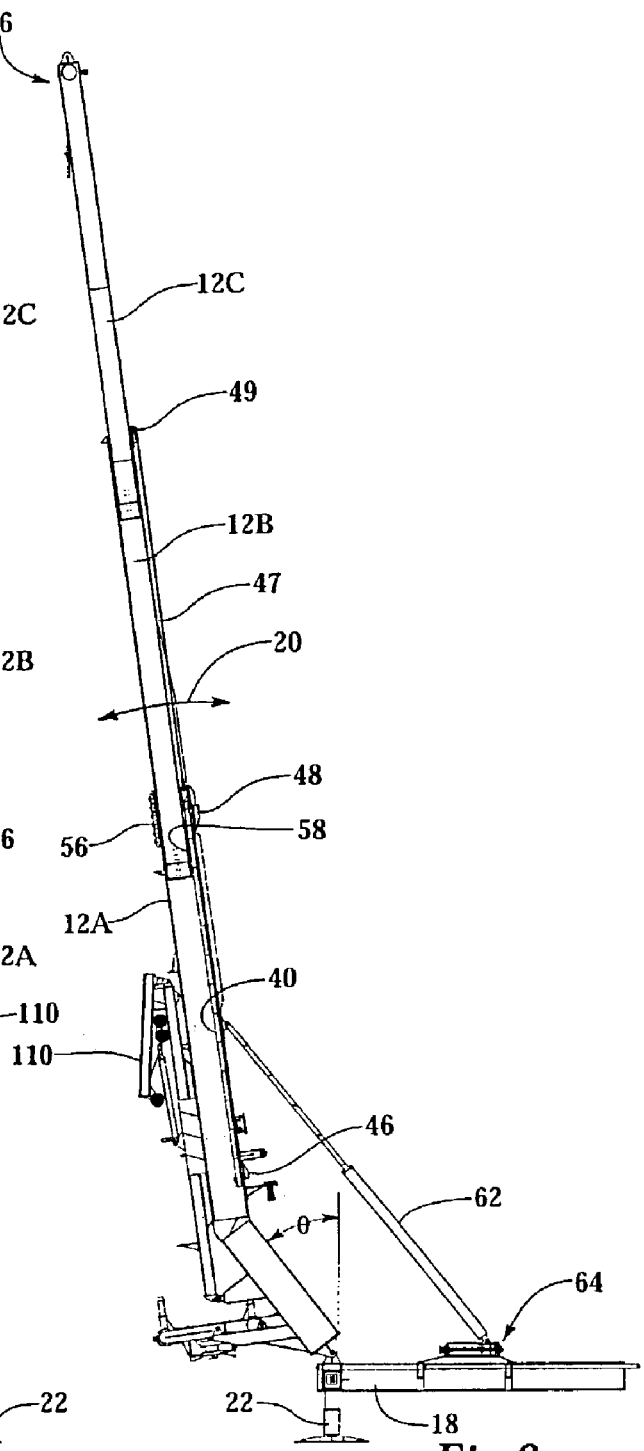
FIG. 3 is a section of FIG. 2, taken along section lines 3—3.

FIGS. 1–3 are various views of an exemplary embodiment of a mast assembly for suspending coiled tubing injectors and other equipment over a wellhead. In this embodiment, mast assembly 10 includes two generally parallel telescoping arms 12 and 14. Each arm includes a plurality of telescoping segments, labeled 12A, 12B and 12C and 14A, 14B and 14C, respectively. The arms are shown fully retracted in FIG. 1: segments 12C, and 14C are drawn or received inside segments 12B and 14B, respectively; and segments 12B and 14B are drawn into segments 12A and 14A, respectively. The mast assembly is shown in a fully extended position in FIGS. 2 and 3.

Cross member assembly 16 extends between, and is connected to, segments 12C and 14C so that the distance from the base of the mast assembly to the cross member assembly increases as the mast assembly telescopes outwardly. Coiled tubing injector or other equipment to be held over a wellhead is attached to the cross member assembly when the mast is in a retracted position and then raised higher by extending or telescoping the mast assembly. The mast assembly 10 is attached to a frame 18 using a pivoting mounting system, so that the mast assembly can be pivoted in a forward and aft direction indicated by arrow 20 in FIG. 3. Frame 18 is intended to be representative of a stable mounting structure, such as a rear of a truck or trailer stabilized with outrigger jacks 22 or a platform. Pivoting the mast forward allows the mast assembly to place the coiled tubing injector over other equipment over the wellhead.

It is preferred, though not necessary for achieving advantages of other aspects or features of the invention, that the coiled tubing injector or other equipment be attached as near to the top of the mast as possible to achieve better control and reduce the necessary overall height of the mast. However, if the height of the equipment is less than the distance to the cross member assembly with the mast fully retracted, it may not be possible to attach the equipment directly to the cross member assembly with a minimum of distance. Though a winch, crane or other conventional mechanism could be used, these mechanisms are prone to failure. Furthermore, as will be subsequently described, it is preferable to be able to transport or store the coiled tubing injector or other equipment with the mast assembly without having to affix it to the cross member assembly until they are ready to be used. This ability enables, for example, a coiled tubing injector and a substantially taller blowout preventer to be transported or stored between the arms of the mast assembly and then joined prior to them being held over and joined to the wellhead. In order to accommodate both a coiled tubing injector and a substantially taller blow out preventer, the exemplary embodiment illustrated in the drawings includes a mechanism for initially hoisting the equipment, in particular a coiled tubing injector in well workover applications, for attachment to the cross member of the mast assembly. This mechanism takes the form of a fixed-length cable 24 that is releasably anchored or attached to the first segment of an arm or to something that does not move as the mast assembly is extended. The cable is looped around an element that moves with the top of the mast, such as around a pulley on the top of the mast assembly or that is part of the cross member assembly. As the mast extends, the cable lifts the equipment up to the cross member assembly. When the equipment reaches the cross member assembly, the cable is released from its anchor.

In the illustrated example, fixed length cable 24 is releasably anchored to flange 26 and it extends around pulleys 28 and 30. Two pulleys are used, as it is preferable, for reasons subsequently described, to be able to move the position of the cable laterally between arms 12 and 14. Pulley 30 is therefore disposed on a lateral transport mechanism at the top of the mast assembly. In the exemplary embodiment, this lateral transport mechanism takes the form of a trolley 32 that moves on a round cross member 34. The cross member serves as a track. The trolley and the cross member are round so that the trolley is able to orient itself to be perpendicular to the ground as the mast pivots forward and aft. Other types of lateral transport mechanism could be used to move the position of the cable, though perhaps with the advantages of this particular mechanism.

In order to simplify operation and provide a secure connection to the mast of the coiled tubing injector or other equipment (not shown in these views), cable 24 has at the end opposite of its anchor a latching member 36 that is used to connect the cable to the coiled tubing injector or other equipment. This latching member cooperates with latch 38 to securely hold the equipment to the cross member assembly. The cable extends through the latch. As it is preferred to have the position of the cable to be moved laterally, the latch is part of or attached to a trolley. As the cable hoists the coiled tubing injector or other equipment into position, a portion of latching member 36 is received within latch 38. When it is received and the latch actuated, the equipment it is securely connected to the cross member assembly. Preferably, the latching is automatic, with a spring loaded latching mechanism being triggered by the latching member entering the latch.

Figure 5:
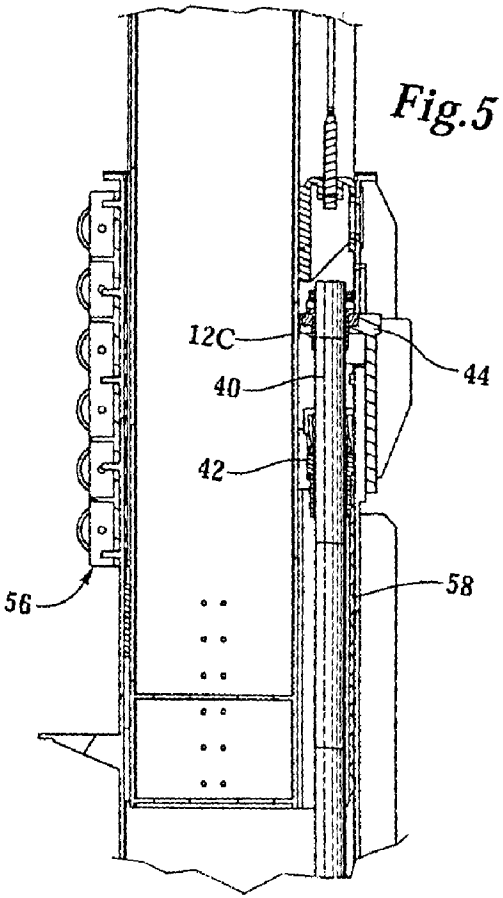
FIG. 5 is a side view of one embodiment of a mast assembly, injector and BOP prepared for transport on a trailer.
Figure 4:
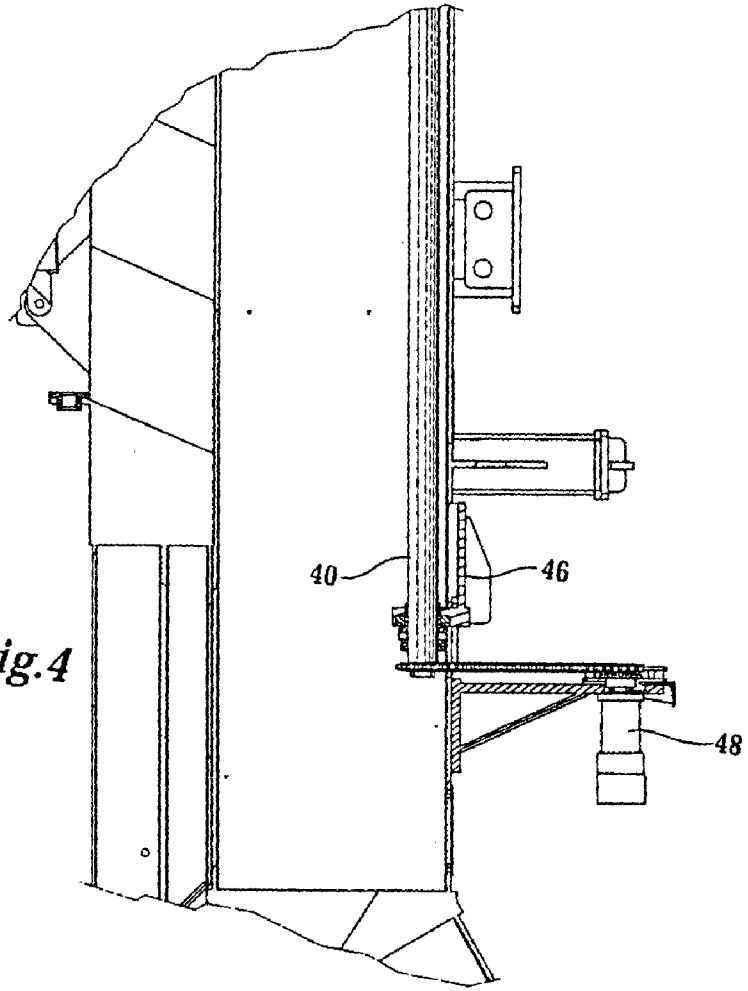
FIG. 4 is a section taken through FIG. 2 along section lines 4—4.

Referring now also to FIGS. 4 and 5 in addition to FIGS. 1–3 a screw 40 and lifting nut 42 is preferred for lifting each second segment, 12B and 14B, out of each first segment, 12A and 14A, respectively. However, other mechanisms, such as a hydraulic cylinder or a motor driven chain, could be used to telescope the arms without sacrificing advantages of other aspects of the exemplary embodiment of the mast assembly or the invention. One reason that a screw is preferred is that a screw can be easily made self-locking by use of low pitch threads. Thus, friction between lifting nut 42 and the screw threads can be used to prevent rotation of the screw under the load of the coiled tubing injector or other equipment if power is lost. Another reason is that low pitch threads also provide a high degree of leverage, allowing less powerful motors to be used to turn the screw.

It is also preferred that both arms have a lifting mechanism, such as the screw, for well servicing applications using coiled tubing. However, not every arm may require a lifting mechanism, depending on the use of the mast assembly. The sectional views of FIGS. 3, 4 and 5 are of arm 12. Sectional views of arm 14 would be substantially similar. Rotating the screw either raises or lowers lifting nut 42, depending on the direction of rotation of the screw. As shown clearly in FIGS. 8 and 9, flanges 43 of the second segment 12B rest on lifting nut 42, which allows the segment to be lifted and lowered (under the force of gravity) by raising or lowering the lifting nut. Note that the screw 40 and the first segment are omitted from this view. Lifting nut may, however, cooperate with segment 12B in any manner to facilitate raising and lowering of the segment.

The screw is preferably placed in tension when the mast assembly is loaded, and not in compression. Therefore, the screw is supported by upper mounting 44, with lower mounting 46 assisting with holding it in place. The lower mountings 46 can also be seen clearly in FIG. 6, and the upper mountings 44 in FIG. 7.

Figure 6:
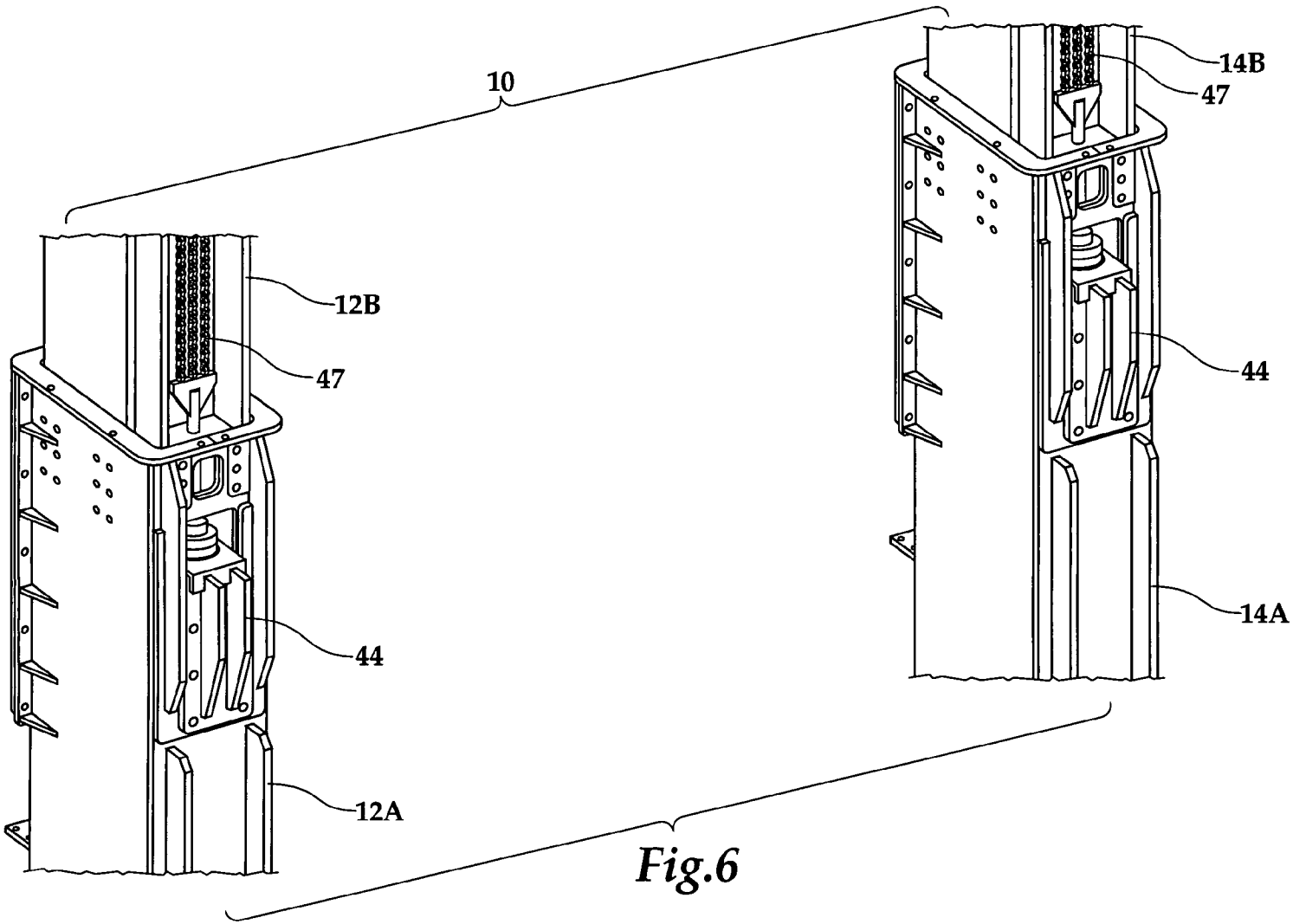
FIG. 6 illustrates a cross section of one embodiment of a first segment.
Figure 7:
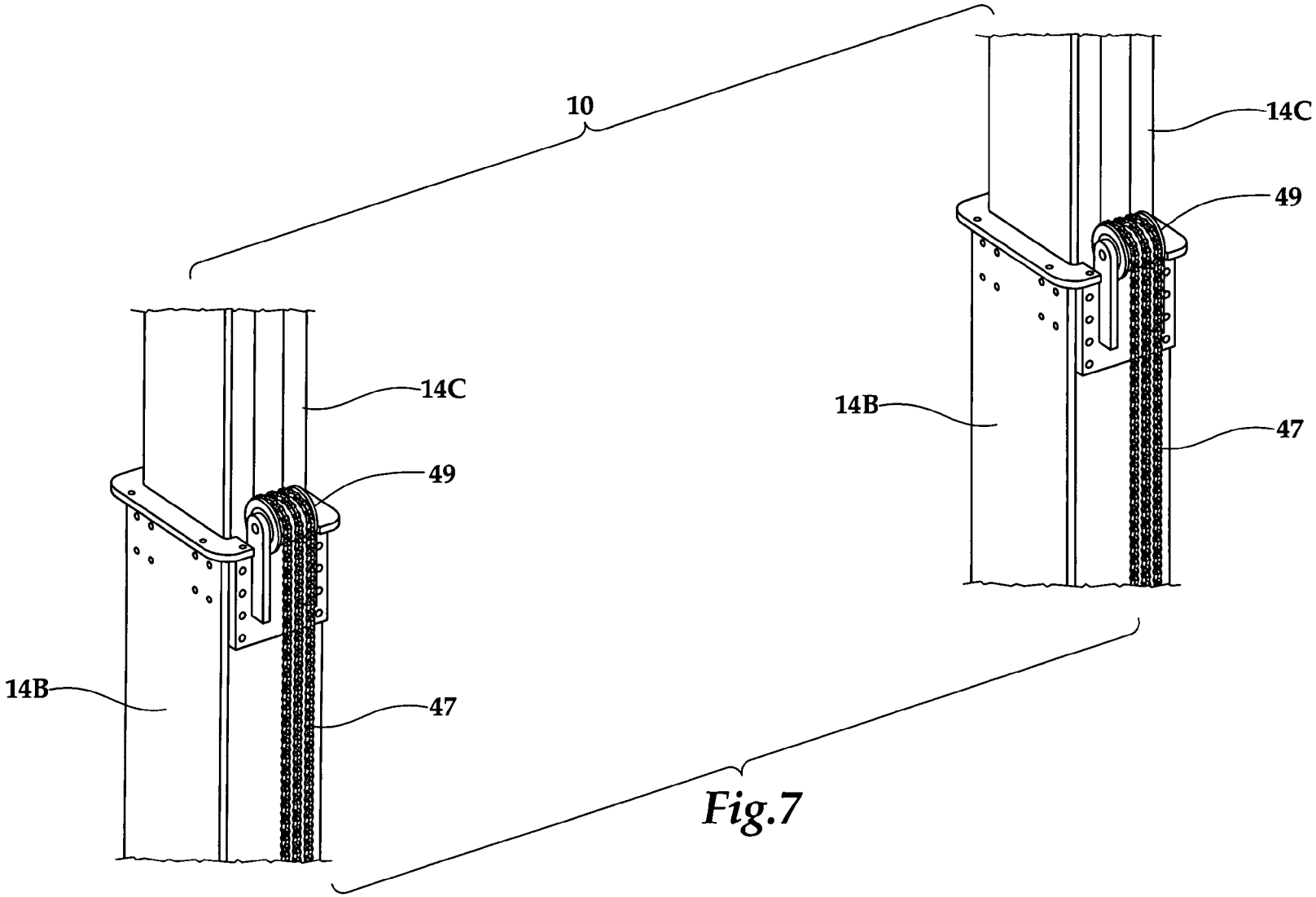
FIG. 7 illustrates a cross section of one embodiment of a first segment and one embodiment of a second segment.

Referring now to FIGS. 6 and 7 in addition to FIGS. 1–5, each of the third segments 12C and 14C are lifted from second segments 12B and 14B, respectively, using a lift chain 47. The lift chains 47 are anchored, respectively, to each of the second segments 12B and 14B, preferably near the bottom of those segments. As best seen in FIG. 3, the chain 47 on each arm loops around a pulley 49 located at the top of the second segment of the arm, and then attaches to the bottom of the third segment. Extension of each of the segments 12B and 14B thus automatically lifts the third segments 12C and 14C out of the second segments. Though a lifting chain is preferred for its simplicity and reliability, other mechanisms can be used to lift each of the third segments out of the first segment. If the arms contain additional segments, these segments could also be extended using lifting chains.

Figure 8:
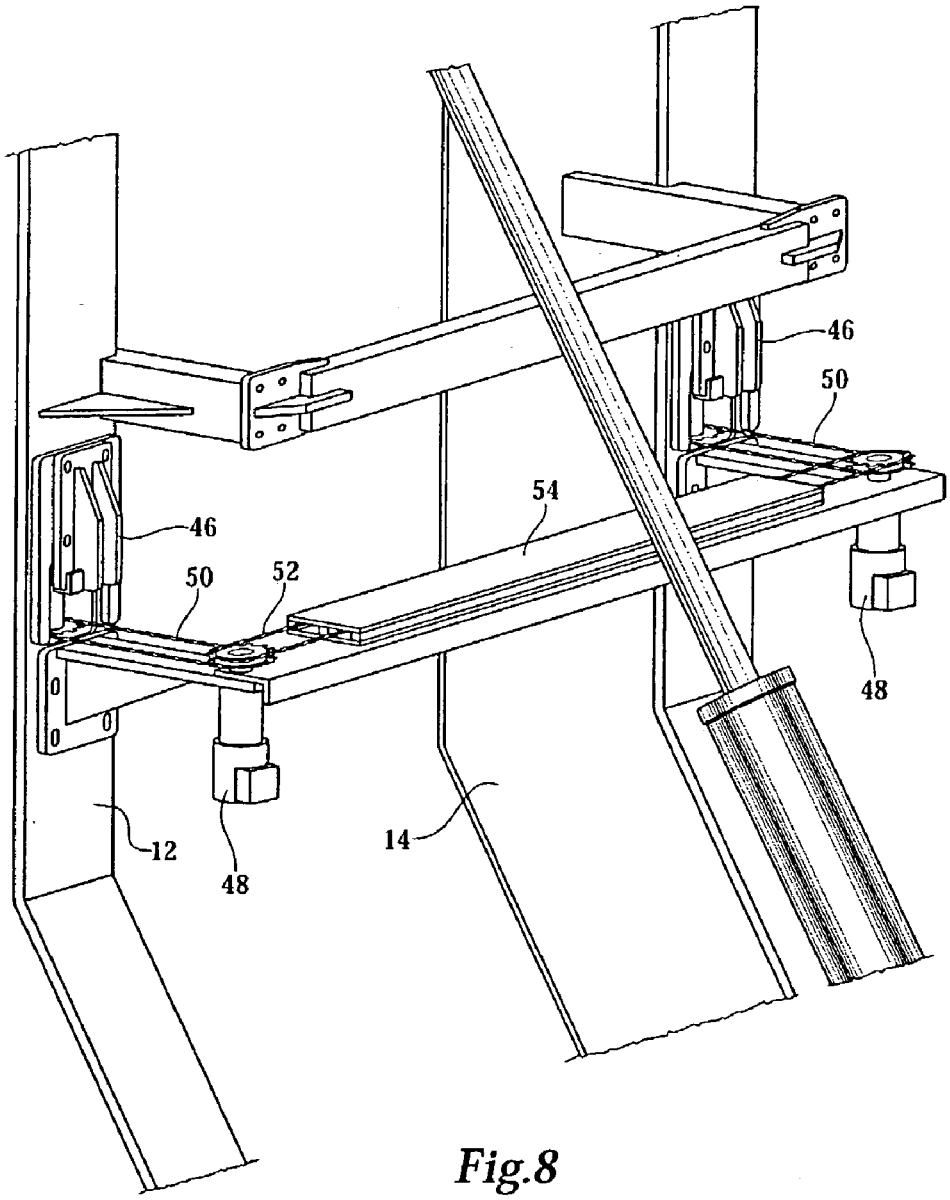
FIG. 8 illustrates a perspective view of one embodiment of a second segment.
Figure 9:
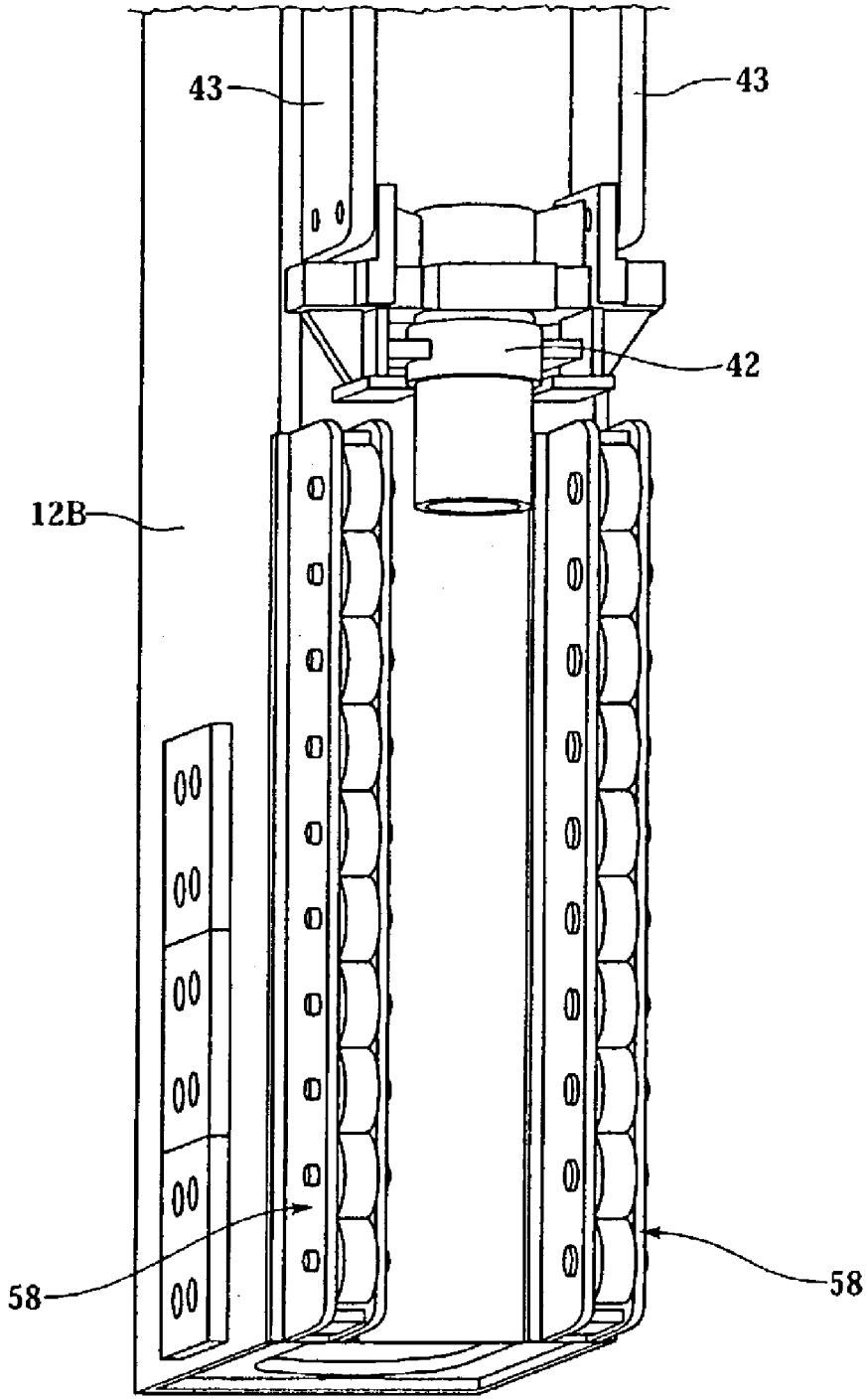
FIG. 9 illustrates a perspective view of one embodiment of a third segment telescopically extending from one embodiment of a second segment.
Figure 10A:
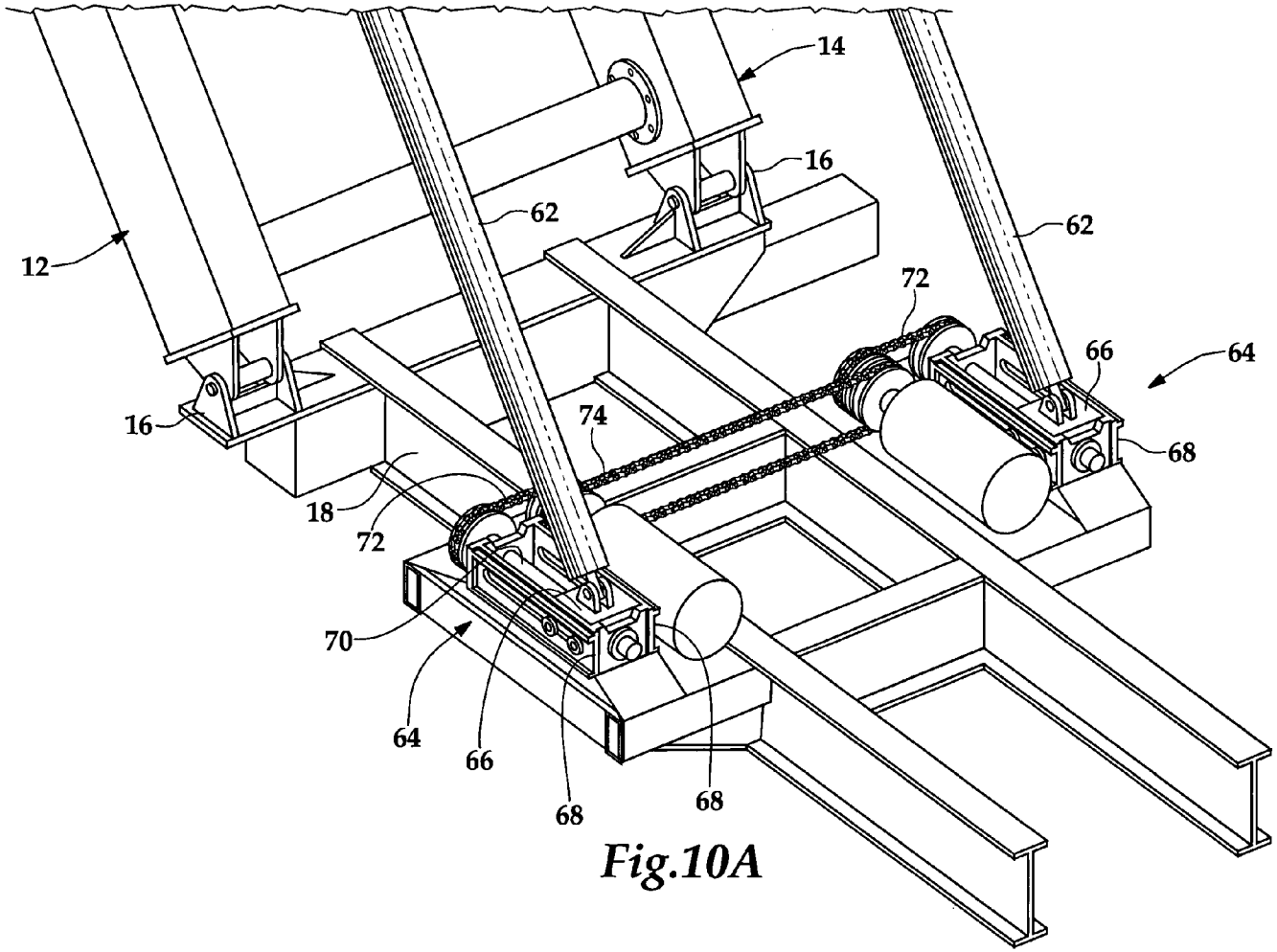
FIG. 10 illustrates a perspective view of one embodiment of a second segment telescopically extending from one embodiment of a first segment.
Figure 10B:
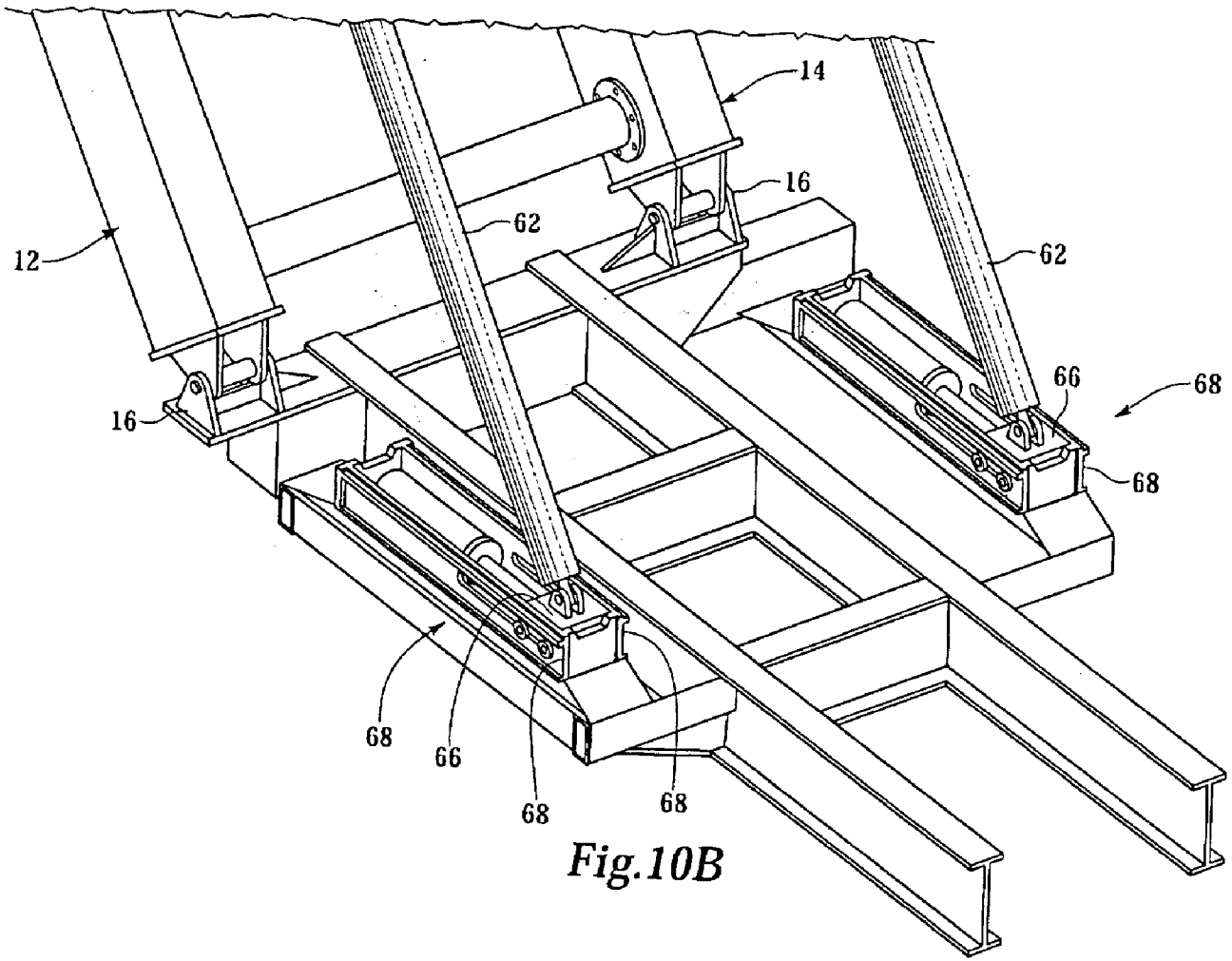
Figure 11:
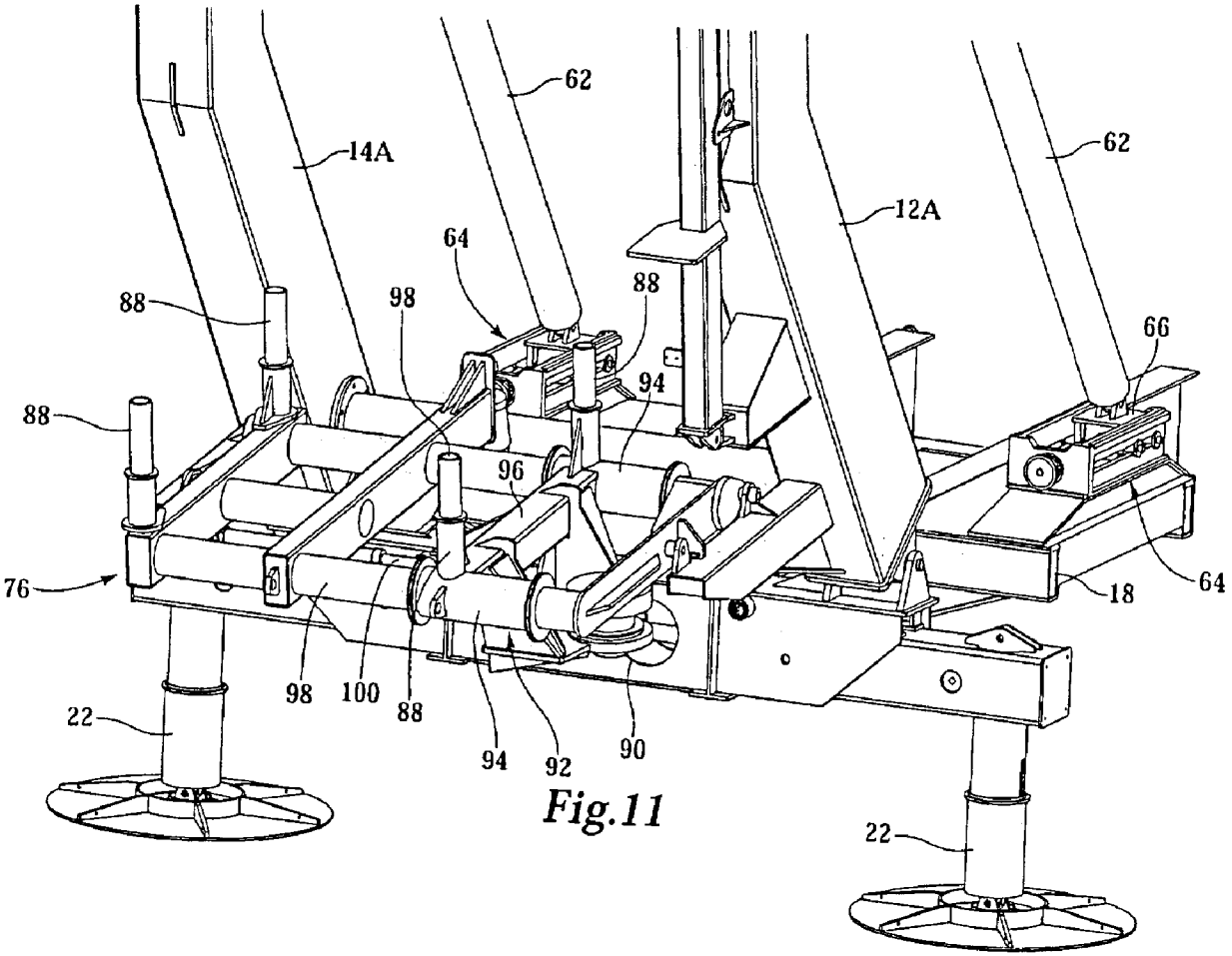
FIG. 11 illustrates a side view of one embodiment of a mast assembly with a plurality of its segments extended.
Figure 12:
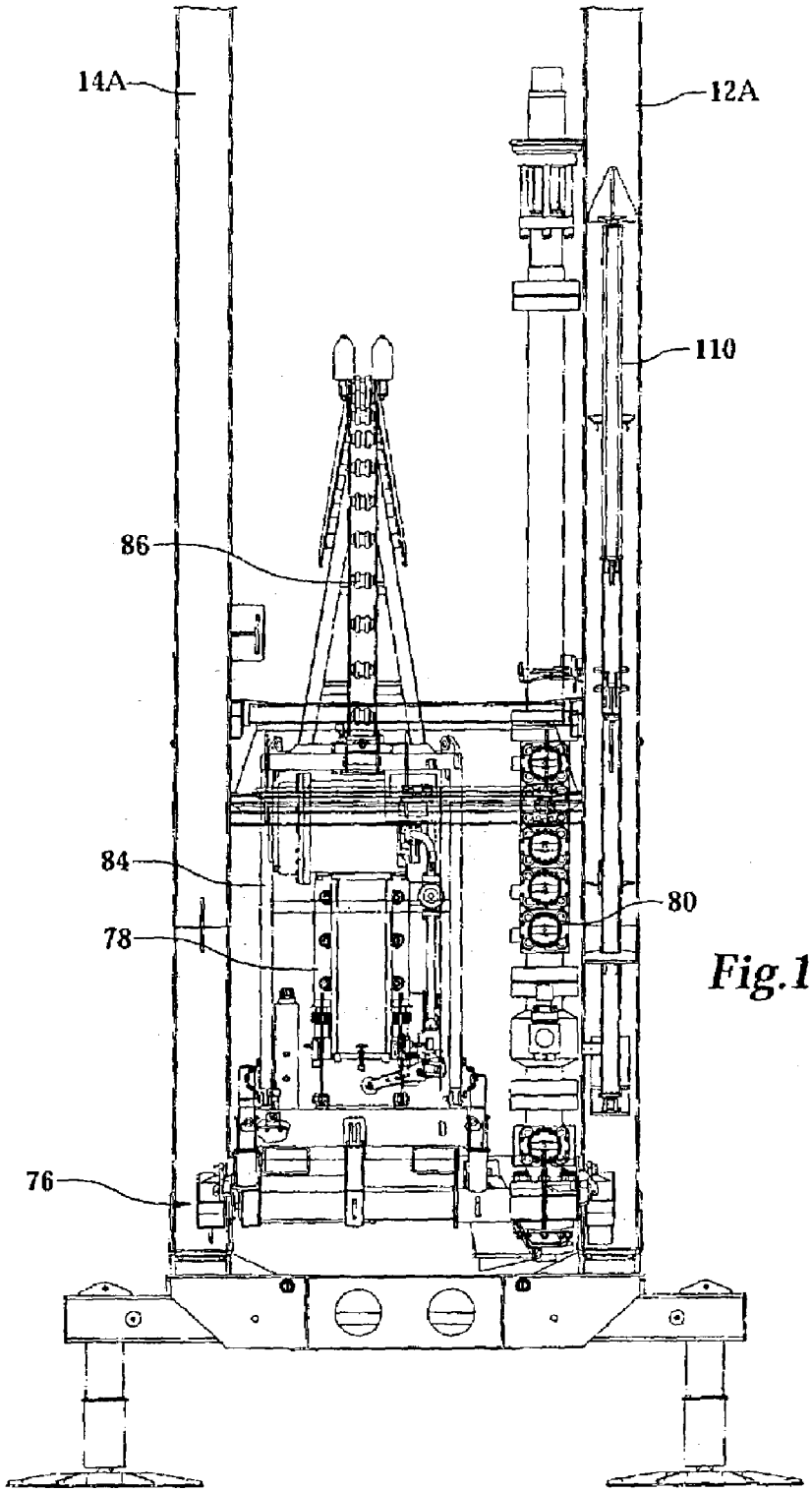
FIG. 12 is a perspective view of one embodiment for synchronizing pivoting of a mast assembly.

Referring briefly now also to FIG. 8 in addition to FIGS. 1–6, rotational power is delivered to the screws by, for example, at least one, motor. In the exemplary mast assembly, two hydraulic motors 48 are used. However, other types of motors could be used. Power is transferred to the screws by means of chains 50. However, other types of transmissions could be used. Chain 52 extends between the two motors and ensures synchronous operation of the transmissions, and thus also synchronous rotation of each screw. Chain 52 is partially obscured by chain guard 54.

Referring now to FIGS. 1–6 and 9, depending on the height and angle of the mast assembly, a heavy load will generate a substantial moment about the top portion of the first segments 12A and 14A of the telescoping arms 12 and 14, resulting in the second segments imposing substantial lateral force on the first segments of the telescoping arms at the tops of the first segments and where the bottom of the second segments push against the inside of the first segments. These loads create friction between the second segments 12B and 14B and on the first segments 12A and 14A, respectively, thus inhibiting movement of the second segments with respect to the first segments. In order to reduce friction between the two lower segments in each arm, the first segments 12A and 14A of each arm in the exemplary embodiment are each provided with a set of roller bearings 56 near the top of the first segments, where the bearings act against the outside of the second segments at the points-where the segments tend to pivot. Furthermore, the second segments 12B and 14B each also include a set of roller bearings 58 near their lower ends that act against the inside surface of the first segments. As the load is not as great, low friction surfaces or pads are used as bearings at the junction of the second segments 12B and 14B with the third segments.

Referring to FIGS. 1–3 and FIG. 10, mast arms 12 and 14 are, as previously indicated, mounted to support frame 18 so that they are permitted to pivot in the forward and aft directions. The mast assembly pivots forward to position the equipment over a wellhead. It preferably also pivots rearward so that it can laid relatively flat for transport and/or storage. Therefore, each arm of the mast is attached to frame 18 with a pivoting connection, such as mounting 60. The mast assembly"s is raised by, and its inclination controlled at least in part, by a pair of hydraulic cylinders 62. Hydraulic cylinder"s are preferred, for several reasons, to support and to control the degree of tilt of the mast assembly. First, they be retracted far enough to accommodate the mast being laid nearly completely flat when pivoted in the aft direction. Second, they can be powered using a hydraulic power source that typically can be found on trucks. Third, in the event of loss of power, they will not collapse.

However, an extending mechanism with a mechanical (e.g. screw) rather than hydraulic lift or cylinder, for example, or other types of mechanisms (e.g. a cable and winch) could be substituted, without loss of advantages of other features of the mast assembly. For example, the mast assembly could be supported, and its angle could be changed, by a non-extendable support member pivotally attached to the mast assembly at one end and a sliding mounting at the other end. However, the amount of travel of a sliding mounting may make mounting the mast on the back of a truck difficult or impossible. Another example is a support structure with articulating members. Structures with articulating members are, however, inherently more expensive to build, require more maintenance, and are more prone to failure than a hydraulic cylinder. A winch and cable could be used to control the tilt of the mast assembly, but a winch and cable is susceptible to breaking and cannot be easily used to raise the mast assembly from a stowed position.

If the mast assembly is mounted, for example, to the back of a truck, there will be a point at which the moment force about the base of the mast assembly, created by the weight of mast and equipment hanging from it, multiplied by the leverage of the mast, cannot be balanced by the structure (vehicle (truck or trailer) or stationary) on which it is mounted. If this moment force is exceeded, the mast assembly and will become unstable and tend to tip over. Lowering the mast lowers this moment force. Thus, when the mast assembly is not fully extended, the mast could be tilted further forward without loss of balance or stability. The angle theta, which is marked on FIG. 3 and represents the forward tilt of the mast assembly, has a maximum value for mast assembly stability that depends on extension of the mast and load. One approach to preventing too much tilt of the mast assembly for the support structure on which it is mounted is to fix the maximum forward angle of the mast assembly based solely on a maximum load with the mast assembly fully extended. However, this approach gives up use of the mast at greater forward tilts that would otherwise not cause tipping, which may be desirable.

It is therefore preferable to have each of the hydraulic cylinders 62 (or, if cylinders are not used, other mechanism for pivoting the mast or arms) coupled or connected at one end to a sliding mounting that limits the forward tilt of the mast assembly when the hydraulic cylinders or other mechanism is fully extended. The sliding mounting could be located either on a base to which the mast is coupled or on the mast itself. The position of the sliding mounting, and thus of the base or ends of the hydraulic cylinders, are automatically determined based on the extension of the mast assembly. As the mast assembly is extended, the sliding mountings are moved aft, away from the mast assembly as necessary to avoid having the angle of the mast assembly exceed the maximum permitted angle for the degree or length of extension. In its simplest form, this automatic correction assumes that hydraulic cylinders, or other support structure or mechanism, is fully extended and the maximum permitted load is being held by the mast assembly. A programmable controller is preferably used to automatically position the sliding mounting. If desired, the programmable controller could also take into account the actual load on the mast when positioning the sliding mounting. The actual load could be, for example, input into the controller or obtained from a load sensor. It could also take into account the degree of extension, or position, of the support structure or mechanism (e.g. the hydraulic cylinders) using a sensor.

In the exemplary embodiment, sliding mounting 64 takes the form of a trolley 66 that travels on two rails 68. The base of a cylinder 62 is pivotally connected with the trolley. In order to move and position each trolley, it is coupled to a screw 70 through a nut (not visible). Turning the screw moves the nut and thus also the trolley. One or more motors are used to turn the screw. In the illustrated example, the motors are hydraulic motors and rotary power is transmitted to the screw by a chain. Hydraulic cylinders or other mechanisms could be substituted for the screws to position the trolleys. To synchronize the two motors, and thus also movement of the trolleys, the outputs of the motors are coupled through timing chain 74. Other means for coupling the outputs of the motors for synchronization can be used. Other forms of sliding mountings could also be used.

Referring now to FIGS. 1–3, 11 and 12, the mast assembly 10 preferably also includes a support structure or mounting for holding a blowout preventer and coiled tubing injector (not shown in these views), or other equipment that is to be hoisted by the mast assembly and positioned over a wellhead. This equipment is positioned on the support, between arms 12 and 14 of the mast assembly. The support, and thus also the equipment, preferably tilt with the mast assembly in at least the aft direction for transport. Support 76 of the exemplary embodiment is desired to carry a coiled tubing injector 78 and a blowout preventer 80 (which are shown only in FIG. 12). The coiled tubing injector is, as is conventional, held within a cage or frame 84. It also has attached to it a goose-neck support assembly 86 for supporting the coiled tubing between the injector and a reel on which it is wound. Support 76 has four posts 88, which are received into openings in the bottom of frame 84 of the coiled tubing injector. The support also includes flange 90, on which the blowout preventer rests. The flange is mounted on a sliding structure 92 so that it can be moved closer to the center between the arms 12 and 14 of the mast assembly. Two of the four posts 88 are also mounted on the sliding structure 90, but only because it simplifies the design. The posts could be mounted in a fixed position if desired. The sliding structure is comprised of two sleeves 94 connected by a cross member 96. The sleeves slide on round members 98. A hydraulic cylinder 100 is used to move the sliding structure. Though the illustrated support and sliding structure have certain advantages, other support and sliding structures can be used to support and move the equipment for transport, handling and/or storage.

For well workover and similar operations, mast assembly 10 first lifts the coiled tubing injector 78 off of support 76. In order to lift the injector off of the support, trolley 32, shown in FIGS. 1 and 2, is moved so that the cable 24 and latching member 36 are centered over the coiled tubing injector and its frame. As described above, the coiled tubing injector is initially hoisted to the cross member assembly 16. The coiled tubing injector is raised further until there is sufficient clearance for the blowout preventer 80 can be placed under it. The blowout preventer is then moved over by operation of the sliding structure 90. If necessary, the coiled tubing injector can also be moved with trolley 32 so that the coiled tubing injector and blowout preventer are centered with respect to each other. The blowout preventer is then joined or attached to the coiled tubing injector, and the combination is then further lifted and moved over the wellhead by extending and tilting the mast assembly 10. Once over the wellhead, the combination is then lowered and joined with it.

Figure 13:
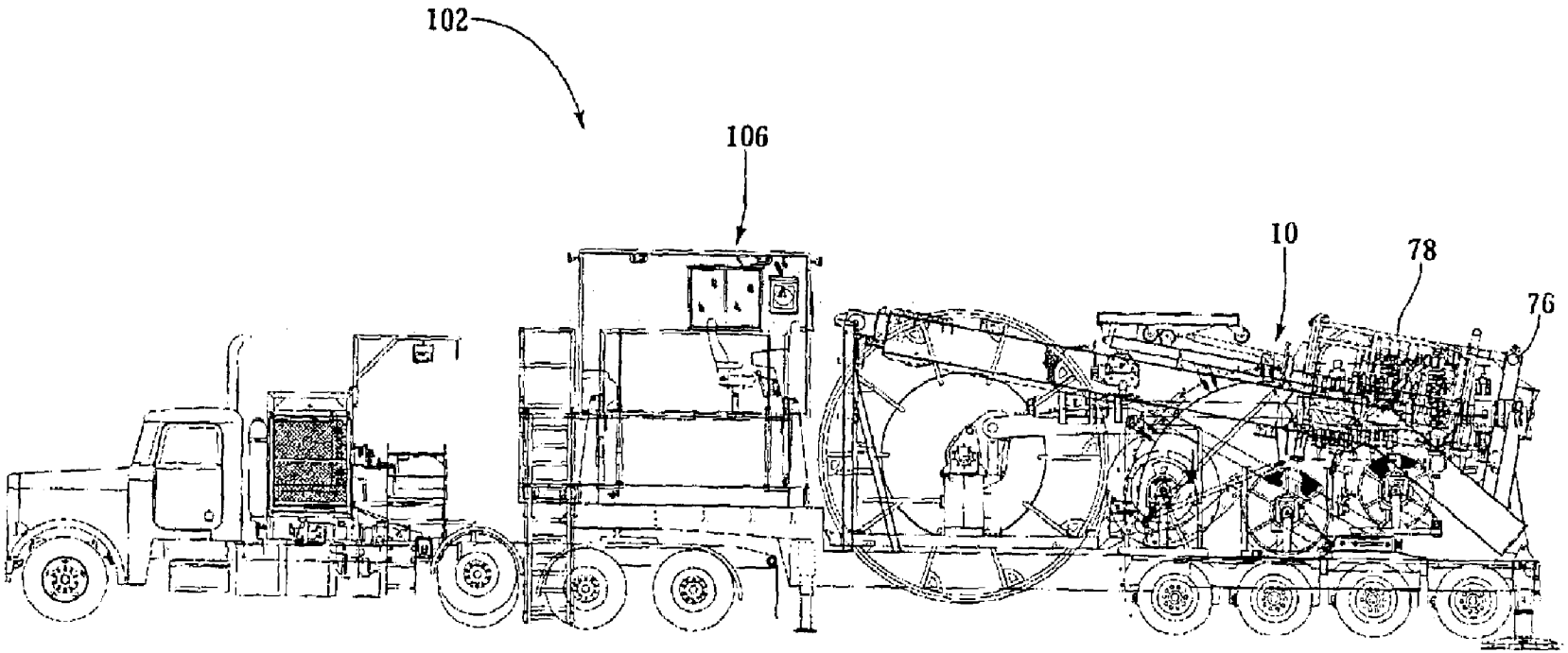
FIG. 13 is a perspective view of one embodiment for synchronizing operation of jack screws during telescoping of a mast assembly.
Figure 14:
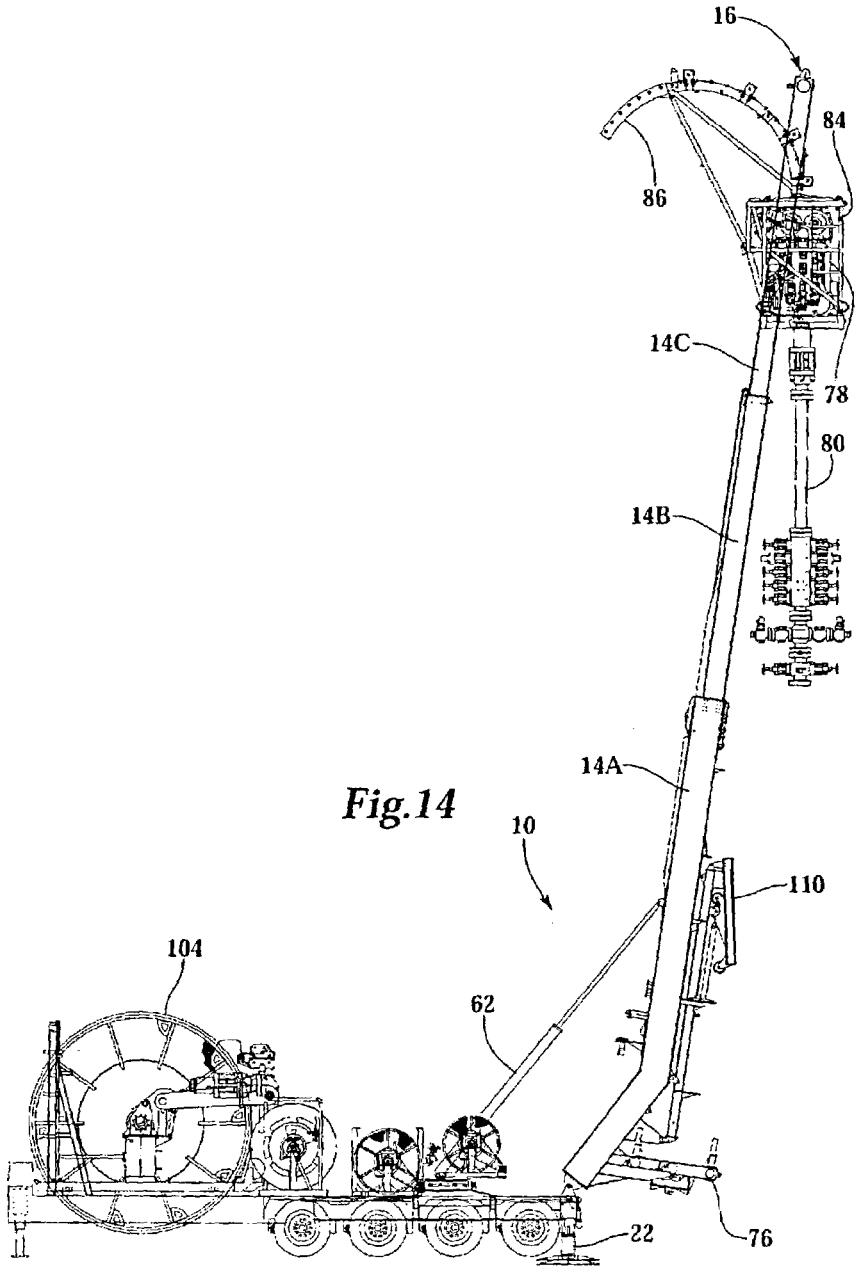
FIG. 14 is a perspective view of a trailer mounted with a fully extended multi-arm mast and reel for coiled tubing.

Referring now to FIGS. 13 and 14, mast assembly 10 is used to particular advantage when mounted on a self-contained truck, such as truck 102, that is used for well workover operations. The mast assembly 10 is preferably mounted on the rear of the truck. In FIG. 13 the mast assembly is laid flat for transportation and storage in order to provide a lower clearance. FIG. 14 illustrated the mast assembly in a fully erect and extended position, with coiled tubing injector 78 joined with blowout preventer 80 and suspended from the cross member assembly 16. The truck preferably also carries a reel 104 of coiled tubing. It may include a control cabin 106 that elevates, as shown in FIG. 14, above the reel for a better view of the wellhead. As shown in FIG. 13, coiled tubing injector 78, in its frame 84, and the blowout preventer are mounted on support 76 for transportation. The support 76 is tilted with the mast assembly so that the coiled tubing injector and blowout preventer are also laying relatively flat, like the mast assembly 10. The truck also includes a hydraulic power pack for supplying hydraulic fluid under pressure to the various hydraulic motors used in the system.

As shown in FIGS. 1 through 3 and 12 through 14, the mast assembly is optionally supplied with a small crane 110 for loading the coiled tubing injector and blow out preventer on the trailer. The crane can be easily folded up, as shown in the various views, to reduce its profile.

What is claimed is:

1. A method for hoisting and positioning oilfield apparatus over a well head, comprising:

coupling the oilfield apparatus to a mast having at least two telescoping load bearing arms prior to extending the at least two telescoping load bearing arms, each of the at least two telescoping load bearing arms being comprised of a plurality of co-axially aligned segments;

lifting the oilfield apparatus through an action of synchronously extending the at least two telescoping arms; and pivoting the at least two telescoping load bearing arms to position the oilfield apparatus over the wellhead.

2. The method of claim 1, wherein the at least two telescoping load bearing arms of the mast are pivotally mounted to a vehicle.

3. The method of claim 1, wherein at least one of the at least two telescoping load bearing arms includes a plurality of segments and a self-locking jack screw for extending a first one of the plurality of segments with respect to a second one of the plurality of segments.

4. The method of claim 3, wherein the at least one of the at least two telescoping load bearing arms includes a lifting chain for telescopically extending a third one of the plurality of segments out of the second one of the plurality of segments as the second of the plurality of segments is extending.

5. The method of claim 1, further comprising automatically limiting the degree to which the at least two arms may be pivoted based on an amount the at least two arms are extended.

6. The method of claim 5, wherein automatically limiting the degree to which the at least two arms may be pivoted includes moving, with respect to points around which the at least two arms are pivoting, a mounting point of a mechanism causing pivoting of the at least two arms based on the amount the at least two arms are extended.

7. The method of claim 1, wherein the mast is mounted to a rear portion of a vehicle for transporting the mast to the well head.

8. A method for hoisting oilfield apparatus over a well head, comprising;

transporting the oilfield apparatus and a mast to well head on a vehicle, the mast having at least two telescoping load bearing arms pivotally mounted to the vehicle, each of the arms being comprised of a plurality of co-axially aligned segments;

coupling the oilfield apparatus to the mast when the mast is in a retracted position;

lifting the oilfield apparatus by an action of synchronously extending the at least two telescoping load bearing arms from the retracted position; and pivoting the at least two telescoping load bearing arms to position the oilfield apparatus over the wellhead.

9. The method of claim 8, wherein at least one of the at least two telescoping load bearing arms includes a plurality of segments and a self-locking jack screw for extending a first one of the plurality of segments with respect to a second one of the plurality of segments.

10. The method of claim 9, wherein the at least one of the at least two telescoping load bearing arms includes a lifting chain for telescopically extending a third one of the plurality of segments out of the second one of the plurality of segments as the second of the plurality of segments is extending.

11. The method of claim 8, further comprising automatically limiting a degree to which the at least two telescoping arms load bearing may be pivoted based on the amount of extension of the at least two arms.

12. The method of claim 11, wherein automatically limiting the degree to which the at least two arms may be pivoted includes moving, with respect to points around which the at least two telescoping load bearing arms are pivoting, a mounting point of a mechanism causing pivoting of the at least two arms based on the amount the two arms are extended.

13. The method of claim 8, wherein the oiled field apparatus includes a coiled tubing injector.

14. The method of claim 13, further comprising transporting a blowout preventer on the vehicle, wherein the coiled tubing injector and blowout preventer are transported between the at least two arms and the blowout preventer and coiled tubing injector are mounted to pivot with the mast between a stowed position and an upright position.

15. The method of claim 13, further comprising, after lifting the coiled tubing injector and before pivoting the at least two telescoping load bearing arms to position the coiled tubing injector over the wellhead, lowering the coiled tubing injector by retracting the at least two telescoping load bearing arms and attaching it to a blowout preventer held in an upright position between the at least two legs.

16. The method of claim 8 wherein the oilfield apparatus is placed between the at least two legs during transporting the oilfield apparatus and the mast on the vehicle, the oilfield apparatus being transported to the site on the vehicle on a mounting that pivots with the at least two legs of the mast between a stowed position and at least an upright position.

17. Apparatus for hoisting oilfield apparatus over a well head, the apparatus comprising a mast assembly with at least two telescoping load bearing arms pivotably coupled to a support base, the plurality of arms each comprising a plurality of synchronously operable, coaxially aligned, telescoping segments for extending and retracting in unison, whereby oilfield apparatus mounted between the at least two arms may be lifted through an action of synchronously extending the at least two telescoping arms and positioned over a well head by pivoting the telescoping segments.

18. The apparatus of claim 17, wherein at least one of the at least two telescoping load bearing arms includes a self-locking jack screw for extending a first one of the plurality of segments of the at least one of the at least two telescoping load bearing arms with respect to a second one of the plurality of segments of the at least one of the at least two telescoping load bearing arms.

19. The apparatus of claim 18, wherein the at least one of the at least two telescoping load bearing arms includes a lifting chain for telescopically extending a third one of the plurality of segments out of the second one of the plurality of segments as the second one of the plurality of segments is extending.

20. The apparatus of claim 17, wherein the mast assembly is mounted to a rear portion of a vehicle for transporting the mast assembly.

21. The apparatus of claim 17 further including a mechanism coupled between the mast assembly and the support base for pivoting the at least two telescoping load bearing arms.

22. The apparatus of claim 21, wherein the mechanism for pivoting the at least two telescoping load bearing arms has a limited range and is coupled at one end to a movable mounting.

23. The apparatus of claim 22, further including a mechanism for moving the mounting automatically based on the extension of the at least two arms, whereby pivoting of the arms in at least one direction is limited by the amount of extension of the at least two arms.

24. The apparatus of claim 21, wherein the mechanism for pivoting includes a hydraulic cylinder.

25. The apparatus of claim 17 further including a mounting for transporting oilfield apparatus, the mounting being disposed between the at least two telescoping load bearing arms and moving with the mast assembly as it pivots between a stowed position and at least an upright position.

26. The apparatus of claim 17, further including a cross member coupled between ends of the at least two telescoping load bearing arms, the cross member including a latch to which oilfield apparatus may be attached for lifting by the mast assembly.

27. The apparatus of claim 26, further comprising a coiled tubing mounting and a blowout preventer mounting disposed between the at least two telescoping load bearing arms, the cross member including a trolley for moving laterally the latch.

28. The apparatus of claim 27, wherein the blowout prevent mounting slides laterally between the at least two telescoping load bearing arms.

29. The apparatus of claim 17, wherein the plurality of synchronously operable, coaxially aligned, telescoping segments comprise roller hearings to reduce friction when raising and lowering the oilfield apparatus.

30. The apparatus of claim 17, comprising:

a mounting coupled to the support base for supporting the oilfield apparatus, wherein the mounting is moveable along the base member for alignment with the transport mechanism.

31. The apparatus of claim 30, wherein the mounting comprises a sliding structure having a pair of sleeves connected by a cross support member.

32. The apparatus of claim 31, wherein a hydraulic cylinder moves the sliding structure.

33. The apparatus of claim 30, wherein the support base is mounted to a vehicle.

34. The apparatus of claim 30, wherein the plurality of synchronously operable, coaxially aligned, telescoping segments comprise roller bearings to reduce friction therebetween when raising and lowering the oilfield apparatus.

35. The apparatus of claim 17, further comprising:

a transport mechanism disposed on and movable along a cross-support member between the at least two telescoping arms, the transport member operable to support the oilfield apparatus to enable lateral positioning of the oilfield apparatus between the at least two telescoping arms.

36. Apparatus for hoisting oilfield apparatus over a well head comprising a mast assembly with at least two telescoping load bearing arms coupled pivotably coupled to a base, the plurality of arms each comprising a plurality of synchronously operable, coaxially aligned, load bearing telescoping segments for extending and retracting in unison, the apparatus further including a mechanism coupled between the mast assembly and the mounting for pivoting the at least two telescoping arms, the mechanism for pivoting being limited in extension and coupled at one end to a moveable mounting, the movable mounting responsive to extension of the at least two telescoping arms.

37. The apparatus of claim 36, further including a cross member coupled between ends of the at least two telescoping load bearing arms, the cross member including a latching mechanism to which oilfield apparatus may be attached for lifting by the mast assembly.

38. The apparatus of claim 36, further including a mounting for transporting oilfield apparatus, the mounting being disposed between the at least two telescoping load bearing arms and moving with the mast assembly as it pivots between a stowed position and at least an upright position, wherein the mounting includes a coiled tubing injector support and a blow out preventer support.

39. The apparatus of claim 38, further including a cross member coupled between ends of the at least two telescoping load bearing arms, the cross member including a latch to which oilfield apparatus may be attached for lifting by the mast assembly and a trolley for moving laterally the latch.

40. The apparatus of claim 38, wherein the blowout preventer support slides laterally between the at least two telescoping load bearing arms.

* * * * *